US006342327B1

(12) United States Patent
Urabe

(10) Patent No.: US 6,342,327 B1
(45) Date of Patent: Jan. 29, 2002

(54) DEVELOPING AGENT HAVING A SEPIOMELANINE PIGMENT

(75) Inventor: Takashi Urabe, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,457

(22) Filed: Dec. 28, 2000

(51) Int. Cl.[7] ..... G03G 9/09
(52) U.S. Cl. ..... 430/108.21; 430/45; 399/321
(58) Field of Search ..... 430/108.21, 45; 399/321

(56) References Cited

U.S. PATENT DOCUMENTS 5,750,301 A * 5/1998 Funato et al. ..... 430/109.3
5,925,363 A * 7/1999 Colin et al. ..... 424/401

FOREIGN PATENT DOCUMENTS

JP 9-200551 7/1997
JP 2000-37957 2/2000

* cited by examiner

*Primary Examiner*—John Goodrow
(74) *Attorney, Agent, or Firm*—Foley & Lardner

(57) ABSTRACT

A sepiomelanine pigment is employed as a coloring agent in a developing agent for forming sepia color, black color and full color images without employing carbon black.

14 Claims, 1 Drawing Sheet

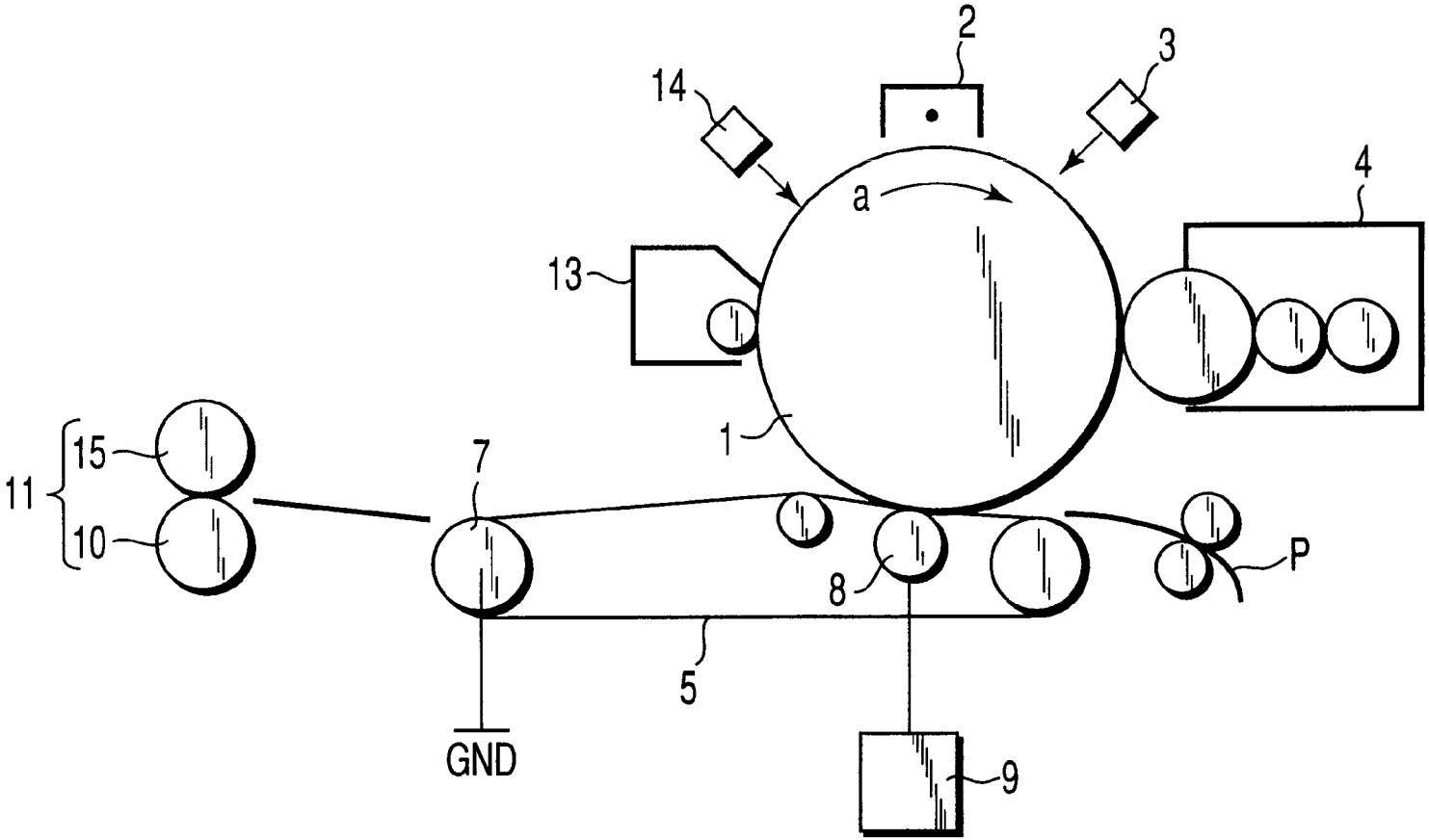
FIGURE

DEVELOPING AGENT HAVING A SEPIOMELANINE PIGMENT

BACKGROUND OF THE INVENTION

The present invention relates to a developing agent to be employed in an image-forming apparatus such as an electrophotographic device, an electrostatic recording device.

The toner to be employed as a developing agent is generally consisted of raw materials including a binder resin, a coloring agent, a wax and a charge control agent. These raw materials are dispersed and kneaded at first, and then pulverized so as to obtain toner particles having a predetermined size. The toner particles are then surface-treated so as to allow an additive such as silica to adhere onto their surfaces, thereby obtaining the toner. This toner can be singly employed as a one-component developing agent or may be mixed with a carrier so as to be employed as a two-component developing agent.

In recent years, it has become possible, on the occasion of forming an image, to perform the development of image in various modes including not only single color or full color modes but also photography finish mode or sepia color mode.

At present, if an image is to be formed with a single color mode, carbon black is mainly employed as a coloring agent for a black developing agent to be employed in this case. There is a problem however that the carcinogenicity of carbon black has been altered in rank from Class 3 to Class 2B on Apr. 12, 1996 by the IARC (International Agency for Research on Cancer). This Class 3 is equivalent to say that it is still insufficient to determine whether the substance is carcinogenic or not. On the other hand, the Class 2B is equivalent to say that the substance is already recognized of its carcinogenicity as far as animals excluding human body are concerned, and there is also a possibility of carcinogenicity of the substance with respect to human body. Therefore, there is an increasing demand for a more safe black coloring agent which is capable of substituting for the carbon black.

There are known two kinds of electrophotographic developing method which are useful for forming an image in a sepia color mode. One of the methods is a full color developing system wherein four kinds of toner, i.e. yellow, Magenta, cyan and black, are superimposed so as to reproduce an image with sepia color. The other is a monochromatic developing system wherein a black toner is employed so as to reproduce an image with halftone.

However, in the former system, a mottled appearance is more likely to be generated due to the misregistration of colors. On the other hand, in the latter system, since the hue inherent to carbon black differs apparently form the hue of sepia color, color drift would be caused to occur. As explained above, it has been very difficult according to the prior art to reproduce an image in a sepia color mode, which is excellent in uniformity and also in color reproducibility.

BRIEF SUMMARY OF THE INVENTION

Therefore, an object of this invention is to provide a developing agent which makes it possible to obtain an image which is excellent in uniformity and also in color reproducibility without necessitating the employment of carbon black which may be harmful to human body.

Another object of the present invention is to provide an image-forming apparatus which makes it possible to obtain an image which is excellent in uniformity and also in color reproducibility without necessitating the employment of carbon black which may be harmful to human body.

According to the present invention, there is provided a developing agent comprising a sepiomelanine pigment as a coloring agent, and a binder resin.

According to the present invention, there is also provided an image-forming apparatus comprising;

an image carrier;

a developing device for forming a developing agent image through a development of an electrostatic latent image formed on the image carrier, the developing device being disposed to face the image carrier and designed to accommodate a developing agent comprising a toner containing a sepiomelanine pigment as a coloring agent, and a binder resin;

a transferring device for transferring the developing agent image onto a recording material; and a fixing device for fixing the developing agent image transferred onto the recording material.

According to the present invention, since a sepiomelanine pigment can be employed singly as a coloring agent, it is now possible to obtain an image which is excellent in uniformity and also in color reproducibility. Further, since a sepiomelanine pigment which is a natural organic pigment is employed as a coloring agent, it is possible to form a brown or black image without necessitating the employment of carbon black whose carcinogenicity is worried about at present.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

The single FIGURE is a schematic view illustrating the construction of one example of image-forming apparatus to which the developing agent of the present invention can be applied.

DETAILED DESCRIPTION OF THE INVENTION

The developing agent according to the present invention comprises a binder resin and a brown black natural organic pigment which is higher in safety than carbon black.

According to the present invention, a sepiomelanine pigment is employed as such a brown black natural organic pigment.

Further, the image-forming apparatus according to the present invention is suited for the employment of the aforementioned developing agent, and comprises an image carrier; a developing device for forming an image by making use of the aforementioned developing agent through a development of an electrostatic latent image formed on said image carrier, said developing device being disposed to face the image carrier; a transferring device for transferring said developing agent image onto a recording material; and a fixing device for fixing said developing agent image transferred onto said recording material.

The raw material for the sepiomelanine pigment is cuttlefish ink or octopus ink. This pigment is consisted mainly of sepiomelanine which can be obtained by a process wherein cuttlefish ink or octopus ink for example is dried at first to obtain a dark brown powder, which is then dissolved in an alkaline solution and then, a dilute hydrochloric acid is further added to the alkaline solution, the resultant solution being subsequently refined to obtain the sepiomelanine.

When a sepia color developing agent employing this sepiomelanine pigment singly as a coloring agent is used, it becomes possible to obtain, in the sepia color mode which has been difficult to realize up to date, a sepia color image which is excellent in uniformity and also in color reproducibility.

In the actual use of this sepia color developing agent, the content of the sepiomelanine pigment should preferably be confined within the range of 0.1 to 20% by weight, more preferably 3 to 10% by weight based on the total weight of the binder resin.

Further, according to the present invention, when the sepiomelanine pigment is co-used together with other kinds of pigment, it is also possible to obtain a black developing agent which is capable of reproducing almost the same level of black color density as that of carbon black.

The sepiomelanine pigment usually has a reflection wavelength band of 580 to 770 nm, in particular 650 to 750 nm, so that it exhibits a reddish black color. Furthermore, by making use of this black developing agent wherein a blue pigment is further added as a coloring agent together with the sepiomelanine pigment to the developing agent, it is possible to adjust the reddish hue of the sepiomelanine pigment, thereby enabling to obtain an image having a sufficient black color density.

Further, when the black developing agent according to the present invention is applied to a color image-forming device, a color image containing no carbon black can be obtained.

As for the blue pigment, it is possible to employ copper phthalocyanine, alkali blue, indanthrene blue, etc. These pigments have a reflection wavelength band ranging from 400 to 580 nm.

When it is desired to employ a black developing agent, the coloring agent may be added to the developing agent at a ratio of 0.1 to 20% by weight, more preferably 3 to 10% by weight based on the total weight of the binder resin. As for the weight ratio between the sepiomelanine pigment and the blue pigment in the coloring agent, it may be suitably adjusted depending on the hue of the kind of blue pigment to be selected so as to obtain a desired black color density. For example, in the case of copper phthalocyanine blue, it may be preferable to employ the blue pigment at a ratio of 0.1 to 30% by weight.

A sepia color image or a black color image can be obtained by means of either a one-component developing system or a binary developing system. In the case of the sepia color image however, it may be preferable to employ the two-component developing system.

Preferable examples of the binder resin useful in the present invention include polyester resin and styrene acrylic resin.

As for the polyester resin, it is possible to employ, as an alcohol monomer constituting the resin, diols such as ethylene glycol, diethylene glycol, triethylene glycol, 1,2-propylene glycol, 1,3-propylene glycol, 1,4-butane diol, neopentyl glycol, 1,4-butane diol, 1,5-pentane diol, 1,6-hexane diol, etc.; bisphenol A alkylene oxide adducts such as bisphenol A, hydrogenated bisphenol A, polyoxyethylenated bisphenol A, polyoxypropylenated bisphenol A, etc.; and other kinds of dihydric alcohol.

Among these monomers, those containing a bisphenol A alkylene oxide adduct as a main monomer are particularly preferable in obtaining a good result.

Namely, when a bisphenol A alkylene oxide adduct is employed as a constituent monomer, it is possible to obtain a polyester having a relatively high glass transition point because of the skeleton of bisphenol A, thus enabling to obtain an excellent anti-blocking property. Further, since the existence of an alkyl group on both sides of the skeleton of bisphenol A acts a soft segment in the polymer, it is possible to realize an excellent low temperature fixing property.

As for the acid monomer constituting the polyester, it is possible to employ alkenyl succinic acids or alkyl succinic acid such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, n-dodecenyl succinic acid, n-dodecyl succinic acid, etc.; acid anhydrides or alkyl ester of these acids; and other kinds of bivalent carboxylic acid.

As for the styrene acrylic resin, it is possible to employ a copolymer of styrene or substitutent thereof, and acrylic resins.

As for the copolymer of styrene or substitutent thereof, it is possible to employ polystyrene homopolymer, hydrogenated styrene resin, styrene-isobutylene copolymer, styrene-butadiene copolymer, acrylonitrile-butadiene-styrene terpolymer, acrylonitrile-acrylate-styrene terpolymer, acrylonitrile-styrene copolymer, acrylonitrile-acryl rubber-styrene terpolymer, acrylonitrile-chlorinated polystyrene-styrene terpolymer, acrylonitrile-EVA-styrene terpolymer, styrene-p-chlorostyrene copolymer, styrene-propylene copolymer, styrene-maleate copolymer, styrene-isobutylene copolymer, styrene-maleic anhydride copolymer, styrene-butadiene rubber, etc.

As for the acrylic resins, it is possible to employ polyacrylate, polymethyl methacrylate, polyethyl methacrylate, poly-n-butyl methacrylate, polyglycidyl methacrylate, fluorinated polyacrylate, styrene-methacrylate copolymer, styrene-butyl methacrylate copolymer, styrene-ethyl acrylate copolymer, etc.

In the case where it is desired to employ a sepia color developing agent, a polyester resin excellent in transparency would be most preferable as a binder resin.

The binder resin according to this invention may also comprise polyvinyl chloride, polyvinyl acetate, polyethylene, polypropylene, polyurethane, polyamide, epoxy resin, rosin, aromatic petroleum resin, chlorinated paraffin, paraffin wax, etc., which can be used singly or in combination thereof.

The binder resin according to this invention may also comprise 0.5 to 5 parts by weight of wax such as low molecular weight polypropylene, low molecular weight polyethylene, liquid paraffin, acid amide, stearate wax, montan wax, Sasol wax, castor wax, chlorinated paraffin, and Cartiba wax.

As for the charge control agent, it is possible to employ a metal-containing azo dye such as Hurryfast black 3804, Pontron S-31, Pontron S-32, Pontron S-34, Pontron S-36 (all, available from Orient Chemical Co., Ltd.); Copycharge NY VP2351 (available from Claliant Co., Ltd.); Eizenespiron black TRH, T-95, T-77 (all, available from Hodogaya Chemical Co., Ltd.); copper phthalocyanine dye; a metal complex of alkyl derivative of salicylic acid; an azine compound such as Pontron N-01; a metallic polymer salt such as CopyLevel NCS VP2145 (available from Claliant Co., Ltd.); and Pontron E-82, Pontron E-84, Pontron E-85 (all, available from Orient Chemical Co., Ltd.). As for the metal-free charge control agent, it is possible to employ TN-105 (available from Hodogaya Chemical Co., Ltd.).

In the case where it is desired to employ a sepia color developing agent, it would be preferable to employ, as a charge control agent, Pontron E-84 (available from Orient Chemical Co., Ltd.), CopyLevel NCS VP2145 (available from Claliant Co., Ltd.), TN-105 (available from Hodogaya Chemical Co., Ltd.) all of which are excellent in transparency; a chrome metal complex, a zinc metal complex, a boron metal complex, a zirconia metal complex, carixarene, CCR, etc. There is not any particular limitation with respect this charge control agent however.

As for the additives to be mixed with a powdery toner, it is possible to employ a fine powdery silica, a fine powdery metal oxide, a cleaning assistant, etc.

As for the fine powdery silica, it is possible to employ silicon dioxide, aluminum silicate, sodium silicate, zinc silicate, magnesium silicate, etc.

As for the fine powdery metal oxide, it is possible to employ zinc oxide, titanium oxide, aluminum oxide, zirconium oxide, strontium titanate, barium titanate, etc.

As for the cleaning assistant, it is possible to employ a fine powdery resin made for example of polymethyl methacrylate, polyvinylidene fluoride, polytetrafluoroethylene, etc. These additives may be surface-treated to make them hydrophobic.

As for the method of manufacturing the toner according to the present invention, the following methods can be employed as typical examples.

First of all, a binder resin, a coloring agent, a wax, a charge control agent and any other components if required are dispersed and mixed together by making use of a ball mill, a V-type mixer, a vorbark, a Henschel mixer, etc.

Then, the resultant mixture is heated to melt and kneaded using a press kneader, a roll, a screw type extruder, a Banbury mixer, etc. to thereby obtain a kneaded product.

Further, this kneaded product is coarsely crushed using a hammer mill, a crusher mill, a jet mill, etc. Subsequently, this coarsely crushed product is further finely pulverized by making use of a jet mill, etc., after which the finely pulverized mixture is classified by means of an air classifier, thereby classifying the mixture into a desired particle size to obtain toner particles.

If required, an additive may be added to the toner particles and then mixed together by means of a high-speed fluid agitator to obtain a desired toner. In this case, it is possible to employ, as this high-speed fluid agitator, a Henschel mixer, a super mixer, a microspeed mixer, etc.

If it is desired to obtain a binary developing agent, a carrier may be added to the toner.

Next, the apparatus of this invention will be explained with reference to the accompanying drawing.

FIGURE shows a schematic view illustrating the construction of one example of the image-forming apparatus to which the developing agent of the present invention can be applied.

As shown in FIGURE, by means of an electrification device 2, a surface potential of −500 to 800V is uniformly applied to a photoreceptor drum 1 which is made rotatable in the direction indicated by the arrow "a". Then, by means of an exposure device 3, an electrostatic latent image is formed on the surface of the photoreceptor drum 1.

By means of a developing device 4, the electrostatic latent image is visualized by making use of a toner which has been negatively charged. The developing agent employed on this occasion contains a binder resin, a toner containing a sepiomelanine pigment, and a carrier. On the downstream side of the developing device, a belt 5 is pressed onto the photoreceptor drum 1, and a paper P as a transferring body is interposed between the belt 5 and the photoreceptor drum 1. By applying a bias voltage of +300 to 5 kV onto the belt 5 by means of a high-voltage source 9, the toner image formed on the photoreceptor drum 1 is transferred onto the paper P. The belt 5 is formed of an elastic belt having a volume resistivity of $10e^8$ to $10e^{12}$ Ω·cm and is sustained by a plurality of rollers. The belt 5 is enabled to rotate as it is actuated by one of these rollers, i.e. a roller 7, at almost the same surface velocity as that of the photoreceptor drum 1. As a feeding component, a conductive elastic roller 8 having a volume resistivity of $10e^2$ to $10e^8$ Ω·cm is employed, thereby enabling to execute a power feeding from a back surface portion of the belt 5 which is contacted with the photoreceptor drum 1. In the ordinary printing operation, the belt 5 and the photoreceptor drum 1 are respectively actuated without being contacted with each other, and when the surface velocity of them becomes almost the same with each other, they are allowed to contact with each other. As a transferring bias is applied onto the feeding roller 8, a transferring body, i.e. the paper P is concurrently transferred to the transcription nip region. The paper that has passed through this transcription nip region between the photoreceptor drum 1 and the feeding roller 8 is electrostatically adsorbed onto the belt 5. However, since the curvature of the belt 5 at the driving roller 7 is relatively large, the tip end portion of the paper P is enabled to be released away from the belt 5 at the downstream end of the belt unit, and hence, the paper P is permitted to be transferred via a guiding member to the fixing unit 11.

At a downstream region of the transcription nip, a residual toner left remained on the surface of the photoreceptor drum 1 is wiped away by a cleaning device 13, after which the photoreceptor drum 1 is discharged by a discharging device 14.

At the fixing unit 11, the fixing of the toner is performed through the heating and pressing by means of a heat roller 15 and a press roller 10, both constituting fixing members.

EXAMPLE

This invention will be further explained in detail with reference to the following examples and comparative examples. By the way, part shown in the following description is based on weight unless otherwise specified.

Example 1

A toner material having the following composition was prepared and dispersed using a gas stream mixer, after which the toner material was kneaded using a biaxial extruder.

| Toner material | |
|---|---|
| Resin: Styrene/acrylic copolymer | 90 parts |
| Coloring agent: Sepiamelanine pigment | 5 parts |
| Wax: Propylene wax | 4 parts |
| Charge control agent: Color metal complex T-77 (Hodogaya Chemical Co., Ltd.) | 1 part |

This kneaded material was made into a sheet, and then coarsely crushed by means of a mechanical mill into particles having a diameter of about 1 mm. This coarsely crushed matter was further finely pulverized by means of a ultra-sonic jet pulverizer and classified by means of an air classifier to obtain a powdery toner having an average volume diameter of about 10 $\mu$m.

Then, 0.5 part of silica was allowed to adhere onto the surface of this powdery toner by making use of an air mixer to obtain a desired toner.

Then, by making use of this toner, the copying of silver salt photograph of sepia color was performed by means of a copying machine of monochromatic binary magnetic brush developing system (Toshiba Co., Ltd.).

When the image thus copied was compared with its original image, the copied image was found to have almost the same hue as that of the original image.

Further, the uniformity and reproducibility of color was investigated on this copied image.

Uniformity of color

The uniformity of color of the copied image was visually evaluated. The image which was very excellent in uniformity and free from the scattering of image was represented by a mark of ○, while the image which was excellent in uniformity but is slightly mottled was represented by a mark of Δ.

Reproducibility of color

The reproducibility of color of the copied image was visually evaluated. The image which was quite identical with the original image was represented by a mark of ◎, the image which was almost identical with the original image was represented by a mark of ○, the image which was slightly different from the original image was represented by a mark of Δ, and the image which was apparently different from the original image was represented by a mark of X.

The results obtained are shown in the following Table 1.

Example 2

A toner was obtained by repeating the same procedures as explained in Example 1 except that a colorless metal complex E-84 (Orient Chemical Co., Ltd.) was substituted for the color metal complex employed in Example 1. Then, the copying of image was performed in the same manner as in Example 1. When the copied image thus obtained was compared with the original image, the copied image was found to have almost the same hue as that of the original image and was also excellent in uniformity without mottled appearance.

Further, the uniformity and reproducibility of color was determined on this copied image.

The results obtained are shown in the following Table 1.

Comparative Example 1

A toner was obtained by repeating the same procedures as explained in Example 2 except that carbon black was substituted for the sepiomelamine employed in Example 2. Then, the copying of image was performed in the same manner as in Example 1. When the copied image thus obtained was compared with the original image, the copied image was found to have quite a different hue from that of the original image but was excellent in uniformity without mottled appearance.

Further, the uniformity and reproducibility of color was determined on this copied image.

The results obtained are shown in the following table 1.

Comparative Example 2

Toners of four different colors were obtained by repeating the same procedures as explained in Example 2 except that disazo yellow, Carmine 6B, copper phthalocyanine and carbon black were employed as four kinds of toner, i.e. yellow, Magenta, cyan and black toners, substituting for the sepiomelamine employed in Example 2. Then, the copying of silver salt photograph of sepia color was performed by making use of these color toners and by means of a copying machine of two-component full color developing system (Toshiba Co., Ltd.). When the copied images thus obtained were compared with the original image, the copied images were found to have slightly different hues from that of the original image. Although these copied images were excellent in uniformity but were accompanied with a mottled appearance.

Further, the uniformity and reproducibility of color was determined on this copied image.

The results obtained are shown in the following Table 1.

TABLE 1

Comparison of sepia color images

| | Developing method | CCA | Uniformity of color | Reproducibility of color |
|---|---|---|---|---|
| Example 1 | Monochromatic developing (Toner with 5% sepiomelamine pigment) | Color | ○ | ○ |
| Example 2 | Monochromatic developing (Toner with 5% sepiomelamine pigment) | Colorless | ○ | ◎ |
| Comparative example 1 | Full color developing | Colorless | Δ | Δ |
| Comparative example 2 | Monochromatic developing (Toner with 5% carbon balck) | colorless | ○ | X |

As seen from Table 1, it was found that when a developing agent containing the sepiomelanine pigment was employed as a coloring agent, the sepia color image obtained was excellent in uniformity of color as well as in reproducibility of color. In particular, when a transparent change control agent was employed, more excellent results could be obtained. By contrast, when the copying was performed using a color toner or a black toner formed of carbon black without employing a developing agent containing the sepiomelanine pigment, the sepia color images obtained were found poor in uniformity of color as well as in reproducibility of color.

Example 3

A toner was obtained by repeating the same procedures as explained in Example 1 except that 4.95 parts by weight of sepiomelanine pigment and 0.05 parts by weight of copper phthalocyanine were employed as a coloring agent substituting for the coloring agent employed in Example 1. Then, a solid image was formed by making use of this toner and by means of a copying machine of two-component developing system (Toshiba Co., Ltd.). When the copied image thus obtained was measured with respect to the hue of image by means of X-Rite, the hue of image was found to be L*=14.55, a*=0.94, b*=1.08. By the way, if it is desired to obtain the same degree of black color density as that of carbon black in a solid image, the value of L* should be confined to not more than 20.

The results obtained are shown in the following Table 2.

Example 4

A solid image was formed by repeating the same procedures as explained in Example 3 except that 4.80 parts by weight of sepiomelanine pigment and 0.20 parts by weight of copper phthalocyanine were employed as a coloring agent substituting for the coloring agent employed in Example 3. When the copied image thus obtained was measured with respect to the hue of image, the hue of image was found to be L*=12.27, a*=0.23, b*=0.56, thus indicating an excellent black color density.

Example 5

A solid image was formed by repeating the same procedures as explained in Example 3 except that 4.65 parts by weight of sepiomelanine pigment and 0.35 parts by weight of copper phthalocyanine were employed as a coloring agent substituting for the coloring agent employed in Example 3. When the copied image thus obtained was measured with respect to the hue of image, the hue of image was found to be L*=9.24, a*=−0.39, b*=−0.21.

TABLE 2

| | Content of sepiomelanine pigment (wt %) | Content of copper phthalocyanine (wt %) | L* | a* | B* |
|---|---|---|---|---|---|
| Example 3 | 4.95 | 0.05 | 14.55 | 0.94 | 1.08 |
| Example 4 | 4.80 | 0.20 | 12.27 | 0.23 | −0.56 |
| Example 5 | 4.65 | 0.35 | 9.24 | −0.39 | −0.21 |
| Example 1 | 5.00 | 0.00 | 24.96 | 2.97 | 4.16 |

As seen from Table 2, it was found that when a black developing agent containing the sepiomelanine pigment and copper phthalocyanine was employed, it was possible to obtain the same degree of black color density as that of carbon black. For the purpose of comparison, the hue of the sepia color image of Example 1 is also shown in Table 2.

In the foregoing examples, the formation of monochromatic images by making use of sepia color and black color developing agents was exemplified. However, it is also possible to apply a black developing agent containing the sepiomelanine pigment and copper phthalocyanine to a full color image-forming device together with a developing agent of cyan, Magenta or yellow to thereby form a full color image.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent comprising a binder resin, and a sepiomelanine pigment as a coloring agent.

2. The developing agent according to claim 1, which further comprises a colorless transparent charge control agent.

3. The developing agent according to claim 1, wherein said charge control agent is a metal complex type compound.

4. The developing agent according to claim 1, wherein said binder resin is at least one kind of material selected from the group consisting of polyester resin, styrene-acrylic resin, polyvinyl chloride, polyvinyl acetate, polyethylene, polypropylene, polyurethane, polyamide, epoxy resin, rosin, aromatic petroleum resin, chlorinated paraffin and paraffin wax.

5. The developing agent according to claim 1, which further comprises a cyan pigment as said coloring agent.

6. The developing agent according to claim 5, wherein said cyan pigment is a copper phthalocyanine-based pigment.

7. The developing agent according to claim 5, wherein said cyan pigment is included at a ratio of 0.1 to 30% by weight based on a total weight of the coloring agent.

8. An image-forming apparatus comprising;

an image carrier;

a developing device for forming a developing agent image through a development of an electrostatic latent image formed on said image carrier, said developing device being disposed to face the image carrier and designed to accommodate a developing agent comprising a toner containing a sepiomelanine pigment as a coloring agent, and a binder resin;

a transferring device for transferring said developing agent image onto a recording material; and a fixing device for fixing said developing agent image transferred onto said recording material.

9. The image-forming apparatus according to claim 8, which further comprises a colorless transparent charge control agent.

10. The image-forming apparatus according to claim 8, wherein said charge control agent is a metal complex type compound.

11. The image-forming apparatus according to claim 8, wherein said binder resin is at least one kind of material selected from the group consisting of polyester resin, styrene-acrylic resin, polyvinyl chloride, polyvinyl acetate, polyethylene, polypropylene, polyurethane, polyamide, epoxy resin, rosin, aromatic petroleum resin, chlorinated paraffin and paraffin wax.

12. The image-forming apparatus according to claim 8, which further comprises a cyan pigment as said coloring agent.

13. The image-forming apparatus according to claim 12, wherein said cyan pigment is a copper phthalocyanine-based pigment.

14. The image-forming apparatus according to claim 12, wherein said cyan pigment is included at a ratio of 0.1 to 30% by weight based on a total weight of the coloring agent.

* * * * *